US007308902B2

(12) United States Patent
Williams et al.

(10) Patent No.: US 7,308,902 B2
(45) Date of Patent: Dec. 18, 2007

(54) SUBSEA VALVE ASSEMBLY WITH REPLACEABLE FIXED ORIFICE INSERT

(75) Inventors: Alfred Moore Williams, Cypress, TX (US); Michael P. Machuca, Houston, TX (US); Eugene E. Eubank, Tomball, TX (US)

(73) Assignee: Dril-Quip, Inc., Houston, TX (US)

( * ) Notice: Subject to any disclaimer, the term of this patent is extended or adjusted under 35 U.S.C. 154(b) by 396 days.

(21) Appl. No.: 10/938,798

(22) Filed: Sep. 10, 2004

(65) Prior Publication Data

US 2005/0081916 A1 Apr. 21, 2005

Related U.S. Application Data

(60) Provisional application No. 60/502,774, filed on Sep. 12, 2003.

(51) Int. Cl.
*F15D 1/00* (2006.01)

(52) U.S. Cl. ..... 137/15.18; 137/315.11; 137/271; 137/454.5; 138/94

(58) Field of Classification Search ..... 137/315.11, 137/454.2, 454.5, 271, 15.18; 138/94
See application file for complete search history.

(56) References Cited

U.S. PATENT DOCUMENTS 4,311,297 A 1/1982 Barrington ..... 251/63.6
4,589,493 A 5/1986 Kelly et al. ..... 166/341
4,848,472 A 7/1989 Hopper ..... 166/344
4,848,473 A 7/1989 Lochte ..... 166/344

(Continued)

FOREIGN PATENT DOCUMENTS

EP 0 426 915 A1 5/1991

(Continued)

OTHER PUBLICATIONS

Rotator Oceaneering AS; Chemical Throttle Valves; Product Brochure, Sep. 2003.

(Continued)

*Primary Examiner*—Kevin Lee
(74) *Attorney, Agent, or Firm*—Paul R. Morico; Baker Botts L.L.P.

(57) ABSTRACT

The present invention is directed to an subsea valve assembly having a fixed orifice insert that can be removed and replaced using a remotely operated vehicle (ROV). The valve assembly includes a removable orifice insert holder and a threaded receptacle housing into which the removable orifice insert holder is received. The remotely operated vehicle (ROV) installs the removable orifice insert holder into the threaded receptacle in situ. The remotely operated vehicle (ROV) can remove an existing removable orifice insert by removing the removable orifice insert holder and replacing the removable orifice insert holder with another the removable orifice insert holder that has been pre-assembled at the surface with a removable orifice insert of a different size. Thus, the valve assembly according to the present invention can be used to control the flow rate of a subsea fluid using a replaceable fixed orifice insert.

53 Claims, 6 Drawing Sheets

U.S. PATENT DOCUMENTS

| | | | | |
|---|---|---|---|---|
| 5,010,956 | A | 4/1991 | Bednar | 166/344 |
| 5,035,258 | A * | 7/1991 | Garnham | 137/454.2 |
| 5,141,012 | A * | 8/1992 | Gavrila | 137/315.11 |
| 6,138,705 | A * | 10/2000 | Chen | 137/315.11 |
| 6,138,774 | A | 10/2000 | Bourgoyne, Jr. et al. | 175/7 |
| 6,609,532 | B1 | 8/2003 | Peterson | 137/15.18 |
| 6,659,133 | B2 * | 12/2003 | Russell | 138/94 |
| 6,752,377 | B1 | 6/2004 | Taylor et al. | 251/363 |
| 2003/0000707 | A1 | 1/2003 | Flowers et al. | 166/374 |
| 2003/0098151 | A1 | 5/2003 | Cove et al. | 166/86.1 |
| 2003/0141072 | A1 | 7/2003 | Cove et al. | 166/368 |
| 2003/0155130 | A1 | 8/2003 | Mentesh et al. | 166/374 |

FOREIGN PATENT DOCUMENTS

| | | |
|---|---|---|
| EP | 0 447 707 A1 | 9/1991 |

OTHER PUBLICATIONS

Rotator Oceaneering AS; Manual CTV; Product Brochure, Sep. 2003.

Rotator Oceaneering AS; Electrical CTV; Product Brochure, Sep. 2003.

Rotator Oceaneering AS; Retrievable CTV; Product Brochure, Sep. 2003.

* cited by examiner

SUBSEA VALVE ASSEMBLY WITH REPLACEABLE FIXED ORIFICE INSERT

RELATED APPLICATION

This application claims the benefit of U.S. Provisional Patent Application Ser. No. 60/502,774, filed Sep. 12, 2003, which is herein incorporated by reference in its entirely as if set forth below.

FIELD OF THE INVENTION

The present invention relates generally to subsea valve assemblies, and, more particularly, to subsea valve assemblies having a fixed orifice insert capable of being replaced by a remotely operated vehicle (ROV).

BACKGROUND OF THE INVENTION

Valves are used in numerous subsea applications. In one application, they are used to regulate the amount of chemical inhibitors injected into the production stream flowing from a subterranean formation to the surface. Chemicals such as methanol, for example, are used to inhibit the formation of hydrates in the tubing used to carry the production from the wellhead to the platform. Other chemicals such as corrosion inhibitors, scale inhibitors, and wax inhibitors, for example, may also be injected into the production stream at or near the wellhead. Typically, such valves are located either at or near the subsea wellhead and/or at or near a subsea manifold.

In another application, subsea valves are used to control the flow of oil, natural gas and other wellbore fluids from the subterranean surface. In a subsea production environment, there are various tree configurations that incorporate such subsea valve assemblies. In the typical subsea arrangement, valves of this type are incorporated into the tree piping. This arrangement typically requires the entire tree to be removed in order to retrieve and/or service such control valves.

Occasionally, it becomes necessary to vary the amount of chemical inhibitors being injected into the production stream and/or vary the flow of product being transmitted from the wellhead to the rig. This has previously not been possible with a fixed orifice device. Rather, variable flow orifice devices have been used for this purpose. One example of such a system employs electronic controls to vary the adjustment of the orifice device. A drawback of such systems, however, is that where multiple subsea wellheads and manifolds are employed throughout the ocean floor very often miles of electrical cable are needed to network the plurality of valves employed in such systems. This has proven to be a very expensive and not very reliable means of varying the control of chemical inhibitors being injected into the production stream.

Other systems have employed variable choke constrictions in subsea applications that are adjusted using remotely operated vehicle (ROV) devices. A drawback of such devices is that it is difficult to determine whether the remotely operated vehicle (ROV) has adjusted the choke to the desired position and such systems are very expensive and complex.

SUMMARY OF THE INVENTION

The present invention is directed to a subsea valve assembly that overcomes or at least minimizes some of the drawbacks of prior art subsea valve assemblies and valve assembly systems.

The subsea valve assembly according to the present invention preferably comprises a receptacle housing having an inner cavity aligned along an axis and a replaceable orifice insert holder aligned along the axis adapted for engagement within the inner cavity of the receptacle housing. The orifice insert holder is formed with an inner flow chamber disposed substantially perpendicular to the axis with a removable orifice insert disposed within the inner flow chamber.

The subsea valve assembly according to the present invention is designed such that a remotely operated vehicle (ROV) can remove the orifice insert from the valve assembly and replace it with an orifice insert having a different diameter. The remotely operated vehicle (ROV) accomplishes this by removing in situ the orifice insert holder from the receptacle housing and replacing it with another orifice insert holder pre-assembled at the surface with an orifice insert of another size. Thus, the valve assembly according to the present invention can be used to vary the flow rate of a subsea fluid, e.g., a chemical inhibitor such as a hydrate, a corrosion inhibitor, a scale inhibitor and/or a wax inhibitor and/or a production enhancement fluid, such as methanol, and the like.

The features and advantages of the present invention will be readily apparent to those skilled in the art, upon a reading of the description of exemplary embodiments, which follows.

BRIEF DESCRIPTION OF THE DRAWINGS

A complete understanding of the present disclosure and advantages thereof may be acquired by referring to the following description taken in conjunction with the accompanying drawings, in which the leftmost significant digit(s) in the reference numerals denote(s) the first figure in which the respective reference numerals appear, wherein.

Figure 1:
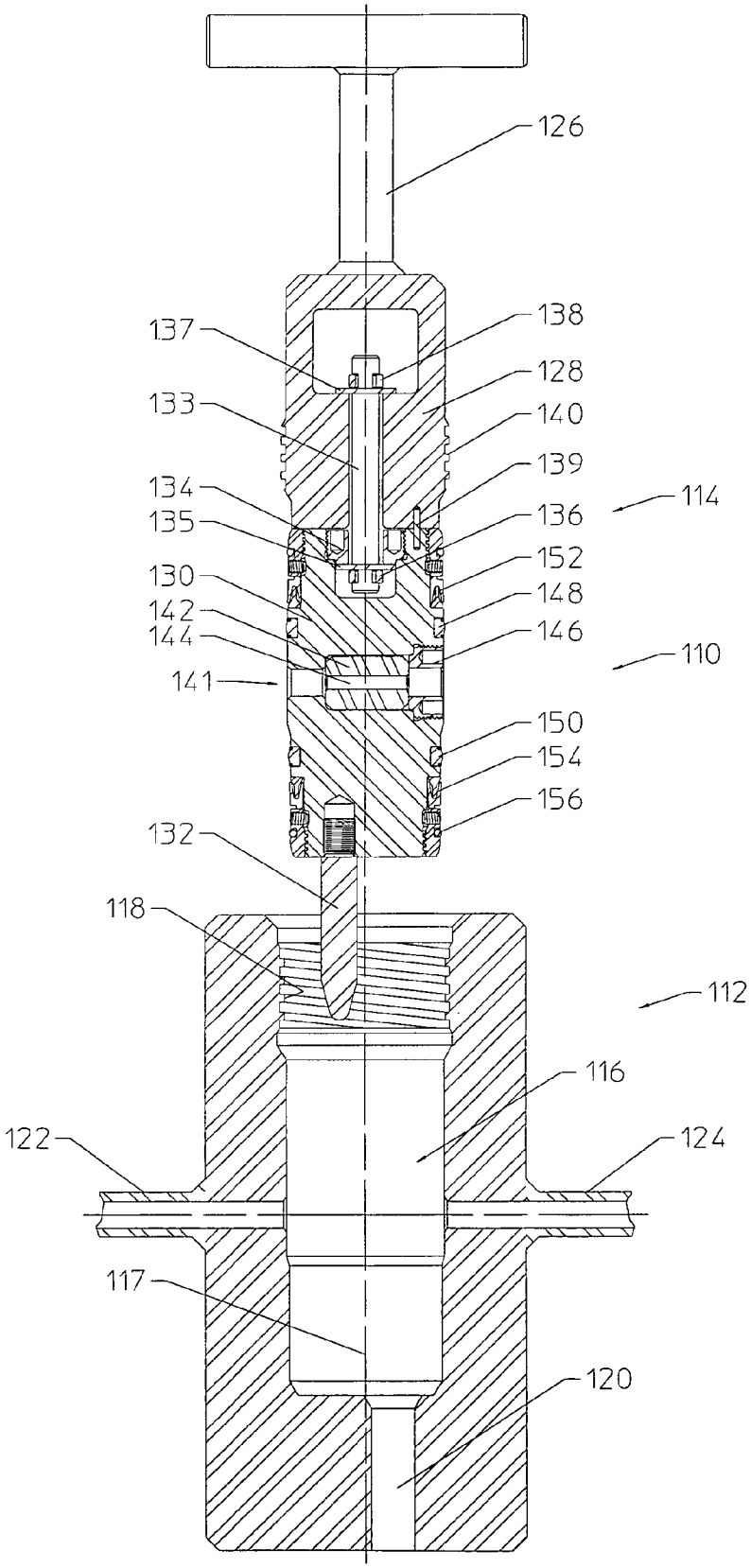
FIG. 1 schematically illustrates a longitudinal sectional view of the subsea valve assembly according to the present invention illustrating the orifice insert holder removed from the receptacle housing.

While the present invention is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, alternatives, that fall within the spirit and scope of the invention as defined by the appended claims.

DETAILED DESCRIPTION OF THE INVENTION

Illustrative embodiments of the invention are described in detail below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The details of various illustrative embodiments of the present invention will now be described with reference to the figures. Turning to FIG. 1, a subsea valve assembly in accordance with the present invention is shown generally by reference numeral 110. The subsea valve assembly 110 includes a threaded receptacle housing 112 and a removable orifice insert holder 114. The threaded receptacle housing 112 is preferably formed of metal and may be placed in the flow line of a subsea chemical injection system (not shown). Alternatively, the threaded receptacle housing 112 may be placed in the tree piping of a subsea production tubing network (not shown). Those of ordinary skill in the art, having the benefit of the present disclosure, will recognize, however, that the subsea valve assembly 110 in accordance with various illustrative embodiments of the present invention has numerous other subsea applications.

The threaded receptacle housing 112 has a generally cylindrically shaped inner cavity 116 aligned along an axis 117, the inner cavity 116 formed within the main body of the threaded receptacle housing 112, which has a helical thread 118 formed at one end of the inner cavity 116 and an alignment pin recess 120 formed at the other end of the inner cavity 116 of the threaded receptacle housing 112. The threaded receptacle housing 112 also has an inlet port 122 and an outlet port 124. The inlet port 122 and outlet port 124 are adapted to couple with the tubing employed in the subsea chemical injection system and/or production tubing as the case may be. The input port 122 and the output port 124 connect to the inner cavity 116, as shown in FIG. 1.

In various illustrative embodiments, the orifice insert holder 114 may be aligned along the axis 117, and may comprise four major components, namely, a T-handle 126, a torque body 128, a main body 130 and an alignment pin 132. The T-handle 126 may fixed to the torque body 128 by welding, braising and/or other similar securing techniques, and may be adapted for engagement by the remotely operated vehicle (ROV, not shown). The torque body 128 fits over a shaft 133, which may be attached at one end of the main body 130 using a retainer nut 134, a thrust washer 135 and a lock ring 136, as shown in FIG. 1. As those of ordinary skill in the art, having the benefit of the present disclosure, will recognize, the shaft 133 can alternatively be integrally formed with the main body 130.

The torque body 128 may be axially secured to the shaft 133 by a thrust washer 137 and a lock ring 138 and/or other similar securing means. The torque body 128 is normally free to rotate relative to the main body 130, but may be temporarily secured to the main body 130 by a shear pin 139. The shear pin 139 may be designed to fail once the alignment pin 132 is inserted into a pin alignment recess 120. The torque body 128 may have a helical thread 140 formed on an outer cylindrical surface of the torque body 128, which is designed to engage the helical thread 118 in the inner cavity 116 of the threaded receptacle housing 112.

The main body 130 is fitted with a removable orifice insert 142. The removable orifice insert 142 fits within an inner flow chamber 141 formed within the main body 130. The inner flow chamber 141 may be disposed substantially perpendicular to the axis 117. The removable orifice insert 142 may be generally cylindrically shaped and may have an inner flow channel 144 formed along its axial center. The removable orifice insert 142 is preferably formed of metal in various illustrative embodiments, but may alternatively be formed of other chemically resistant materials. An orifice retainer nut 146 may be used to retain the removable orifice insert 142 within the main body 130. The orifice retainer nut 146 may have two screws for attachment to the main body 130. However, as those of ordinary skill in the art, having the benefit of the present disclosure, will recognize, other securing means may be employed.

The inner flow channel 144 of the removable orifice insert 142 may have an inner diameter that may be substantially any size. Indeed, one of the many advantages of the present invention is that the removable orifice insert 142 may be removed and replaced with an orifice insert having a different inner diameter inner flow channel 144. More specifically, the inner flow channel 144 of the removable orifice insert 142 is what controls the flow of chemical inhibitors into the wellhead and/or the flow of the production stream through the subsea production tubing, as the case may be.

The removable orifice insert holder 114 may further comprise a pair of elastomeric seal rings 148 and 150 disposed within corresponding circumferential grooves formed within an outer surface of the main body 130 just above and below, respectively, the removable orifice insert 142, as shown in FIG. 1, for example. The elastomeric seal rings 148 and 150 may be provided to prevent the chemicals and/or other product flowing through the subsea valve assembly 110 from leaking out of the subsea valve assembly 110. The elastomeric seal rings 148 and 150 in various illustrative embodiments are preferably formed of rubber, nitrile, plastic, metal, composites and/or other seal materials compatible with the chemical and/or subsea environment.

The removable orifice insert holder 114 in various illustrative embodiments preferably may further include a pair of metal lip seal rings 152 and 154, which may be disposed within corresponding circumferential grooves formed within the outer surface of the main body 130 just above and below the elastomeric seal rings 148 and 150, respectively. The metal lip seal rings 152 and 154 are conventional devices known in the art. The metal lip seal rings 152 and 154 are in contact with a sealing surface when installed. As pressure is applied, the metal lip seal rings 152 and 154 are forced harder into contact with the sealing surface to achieve a high integrity seal.

The removable orifice insert holder 114 may further comprise a wiper seal ring 156, which may be disposed within a circumferential groove formed within the outer surface of the main body 130 just below the lower metal lip seal ring 154. The wiper seal ring 156 in various illustrative embodiments is preferably formed of an elastomeric material, e.g., a nitrile and/or a vitan. The wiper seal 156 may be provided to wipe the inner surface of the inner cavity 116 clean so that, as the removable orifice insert holder 114 is installed and/or reinstalled into the threaded receptacle housing 112, no debris, such as sand, left on the inner surface of the inner cavity 116, will come into contact with the metal lip seals 152 and 154 and potentially damage the sealing surfaces.

The installation and removal of a removable orifice insert 142 will now be described. First, as those of ordinary skill in the art, having the benefit of the present disclosure, will recognize, the threaded receptacle housing 112 is installed either at or near the subsea tree and/or at or near a subsea manifold. The subsea valve assembly 110 is initially installed with the removable orifice insert holder 114 and the removable orifice insert 142 in place, so the first operation following initial installation is to replace the original removable orifice insert 142. This may be accomplished first by removing the original removable orifice insert holder 114 and replacing the original removable orifice insert holder 114 with a replacement removable orifice insert holder 114 pre-assembled with a new removable orifice insert 142. The removal of the original removable orifice insert holder 114 will be described below.

The installation of the replacement removable orifice insert holder 114 will now be described. First, the replacement removable orifice insert holder 114 is set up and/or pre-assembled at the surface. Set up and/or pre-assembly of the replacement removable orifice insert holder 114 may involve installing the removable orifice insert 142 into the replacement removable orifice insert holder 114 by securing the removable orifice insert 142 in place with the respective orifice retainer nut 146 and rotationally aligning the torque body 128 relative to the main body 130 and fixing the torque body 128 in place using the shear pin 139, which is designed to shear and/or fail at the desired predetermined torque value. Next, the replacement removable orifice insert holder 114 may be loaded onto the remotely operated vehicle (ROV, not shown), which transports the replacement removable orifice insert holder 114 to the threaded receptacle housing 112 for installation.

Figure 2A:
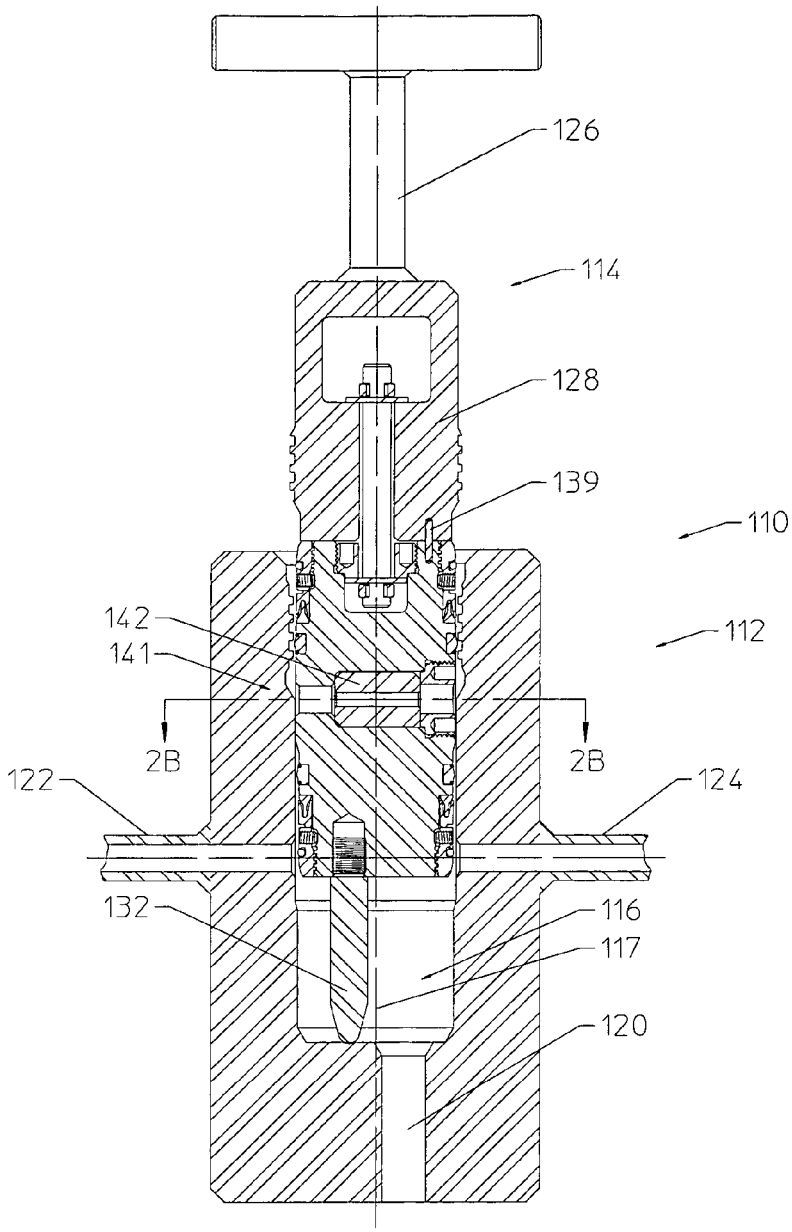
FIG. 2A schematically illustrates a longitudinal sectional view of the subsea valve assembly shown in FIG. 1 illustrating the orifice insert holder partially inserted into the receptacle housing.
Figure 2B:
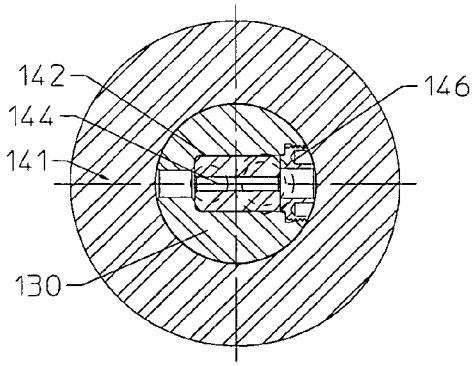
FIG. 2B schematically illustrates a horizontal sectional view of the orifice insert holder within the receptacle housing as seen along line 2B-2B of FIG. 2A.

Once the remotely operated vehicle (ROV) reaches the threaded receptacle housing 112, the first step is to remove the existing removable orifice insert holder 114, which will be described below. Once the existing removable orifice insert holder 114 is removed, the next step is for the remotely operated vehicle (ROV) to align axially and vertically the replacement removable orifice insert holder 114 with the inner cavity 116 of the threaded receptacle housing 112, as shown in FIG. 1, for example. Once axially and vertically aligned, the replacement removable orifice insert holder 114 is ready to be inserted into the threaded receptacle housing 112. During the insertion step, the alignment pin 132 may act to guide the replacement removable orifice insert holder 114 into the inner cavity 116. The remotely operated vehicle (ROV) may continue to insert the replacement removable orifice insert holder 114 axially into the inner cavity 116 until the alignment pin 132 lands on the bottom wall of the inner cavity 116. This position is shown in FIG. 2A, for example. In this position, the replacement removable orifice insert 142 has not been rotationally or axially aligned with the input port 122 and/or the output port 124.

Figure 3A:
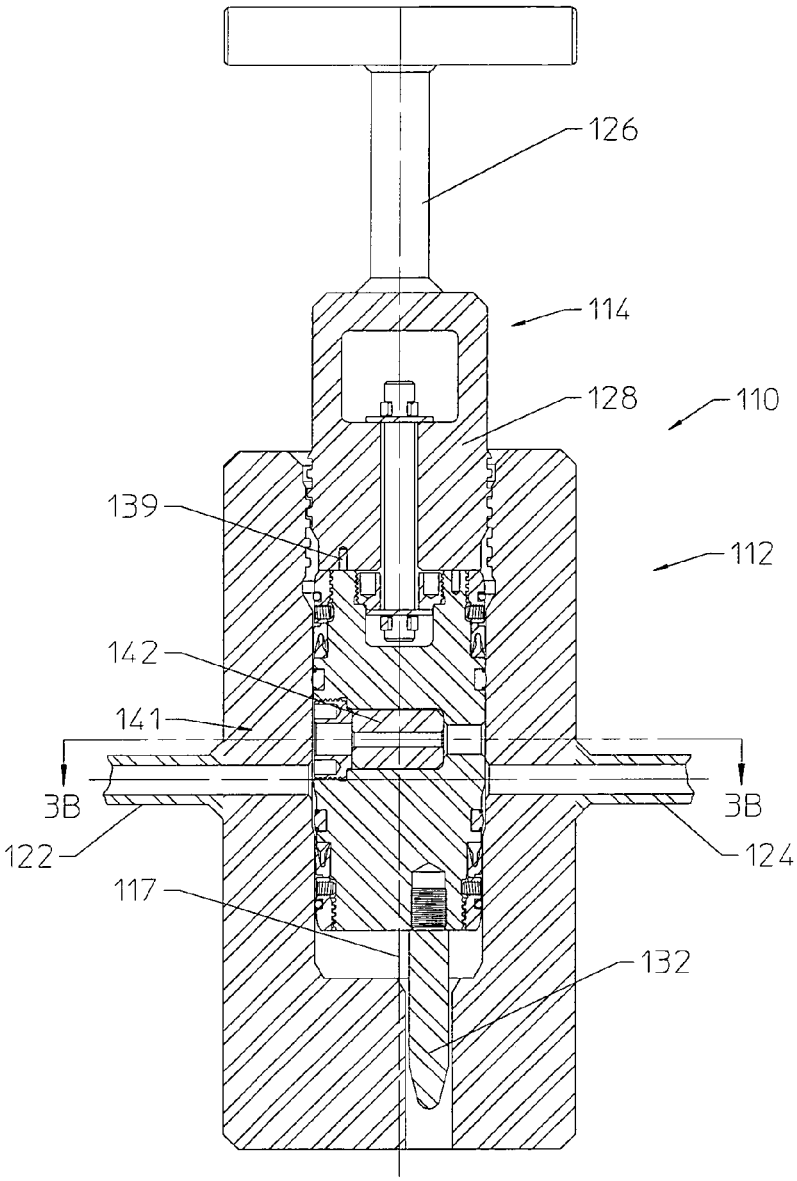
FIG. 3A schematically illustrates a view similar to that shown in FIG. 2A, but in which the orifice insert holder has been rotated within the cavity of the receptacle housing far enough that an alignment pin on the orifice insert holder has been partially inserted into a recess in the lower end of the cavity.

Next, the remotely operated vehicle (ROV) rotates the replacement removable orifice insert holder 114 until the alignment pin 132 is aligned with the pin alignment recess 120. Once aligned, the remotely operated vehicle (ROV) can push the replacement removable orifice insert holder 114 further into the inner cavity 116, as shown in FIG. 3A. At this point, the helical thread 140 formed on the outer surface of the torque body 128 engages with the helical thread 118 formed on the inner surface of the inner cavity 116. The remotely operated vehicle (ROV) continues to apply a rotational torque (a force directed about an axis) to the replacement removable orifice insert holder 114, however, because the main body 130 is now held in place in the inner cavity 116 by the alignment pin 132, the main body 130 resists rotation. Once enough torque is applied, the shear pin 139 fails, causing the torque body 128 to rotate about the shaft 133 relative to the main body 130. This rotation causes the torque body 128 to advance downward into the threaded receptacle housing 112, which, in turn, forces the main body 130 downward. Furthermore, an additional advantage of having the torque body 128 rotate independently of the main body 130 is that the seal surfaces of the main body 130 are not damaged.

Figure 3B:
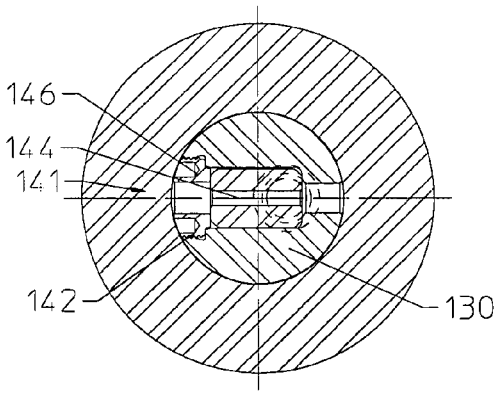
FIG. 3B schematically illustrates a view similar to that shown in FIG. 2B, taken along line 3B-3B of FIG. 3A.
Figure 4:
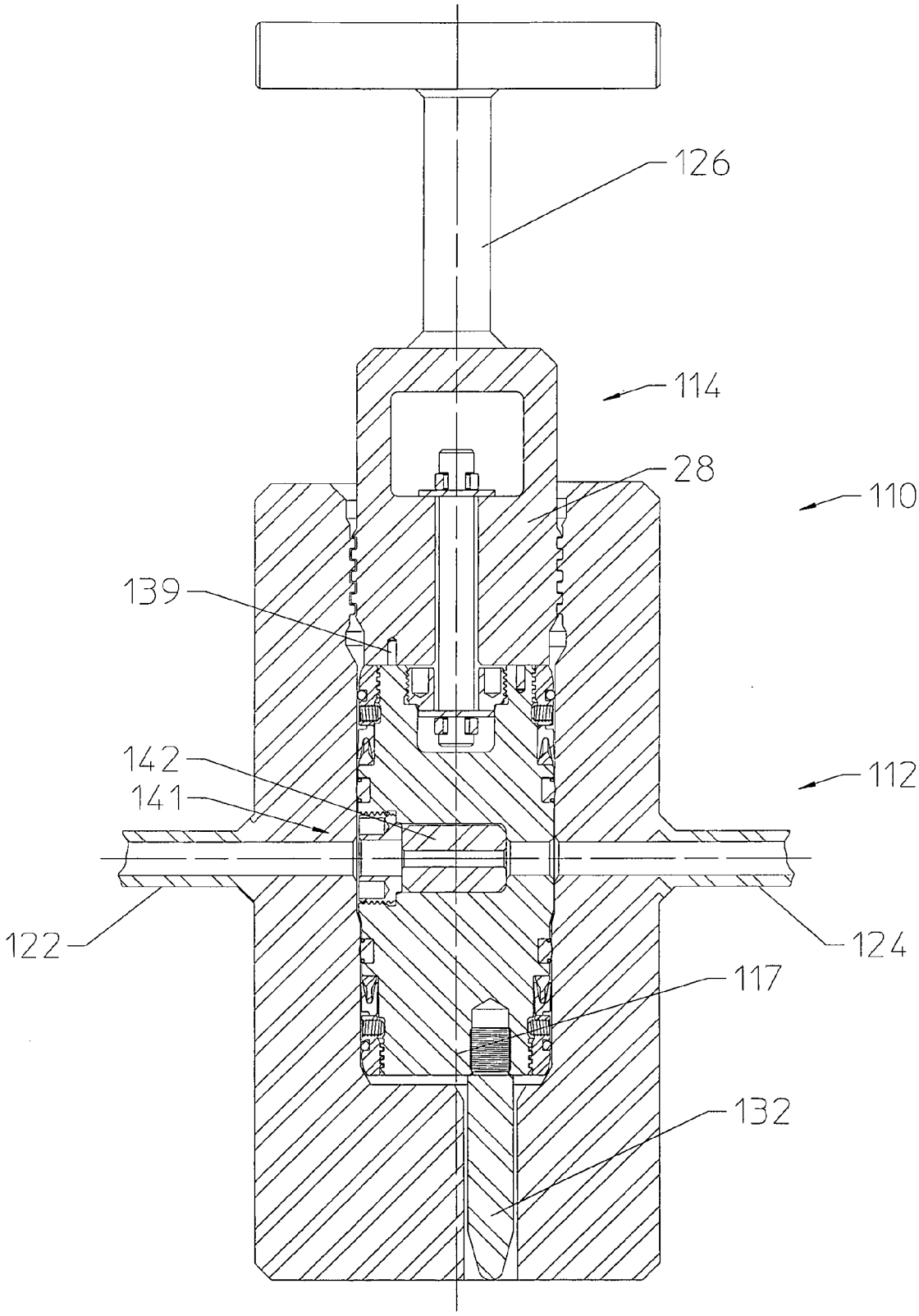
FIG. 4 schematically illustrates a view similar to that shown in FIG. 3A, but showing instead the orifice insert holder fully inserted within the cavity of the receptacle housing.

The remotely operated vehicle (ROV) continues to apply a rotational torque to the torque body 128 until the replacement removable orifice insert holder 114 is completely engaged within the inner cavity 116 of the threaded receptacle housing 112. Once the replacement removable orifice insert holder 114 fails to advance any further, the removable orifice insert 142 is aligned with the input port 122 and the output port 124, as shown in FIG. 4. The inner flow channel 144 becomes rotationally aligned with the flow channel of the input port 122 and the output port 124 once the alignment pin 132 is inserted into the pin alignment recess 120 (as shown, for example, in FIGS. 3A and 3B), but the inner flow channel 144 only becomes axially aligned with the flow channel of the input port 122 and the output port 124 when the torque body 128 can no longer be rotated, as shown in FIG. 4. Furthermore, rotation of the torque body 128 provides the force necessary to preload the metal-to-metal lip seals 152 and 154.

Removal of the removable orifice insert holder 114 and the removable orifice insert 142 will now be described. The remotely operated vehicle (ROV) applies a reverse torque to the T-handle 126, which causes the torque body 128 to rotate relative to the main body 130 since the two bodies are no longer rotationally fixed by the shear pin 139. As the torque body 128 rotates in the reverse direction, the torque body 128 moves upward, carrying the main body 130 along with the torque body 128 due to the shaft 133 connecting the torque body 128 and the main body 130. Once the helical threads 140 (on the torque body 128) and the helical threads 118 (on the inner surface of the inner cavity 116) are no longer engaged, the remotely operated vehicle (ROV) is able to pull the entire removable orifice insert holder 114 out of the threaded receptacle housing 112 and then transport the removable orifice insert holder 114 to the surface, so that the removable orifice insert holder 114 can be set up for reinstallation either in the same threaded receptacle housing 112 or another one. In various illustrative embodiments, preferably, the remotely operated vehicle (ROV) is preloaded with the replacement removable orifice insert holder 114 and associated replacement orifice insert 142, so that the remotely operated vehicle (ROV) can remove the existing removable orifice insert holder 114, and the associated removable orifice insert 142, and install the replacement removable orifice insert holder 114, and the associated replacement removable orifice insert 142, in one trip. The removable orifice insert holder 114 and the associated removable orifice insert 142 that have been removed can then be taken to the surface and set up for the next required use.

Figure 5:
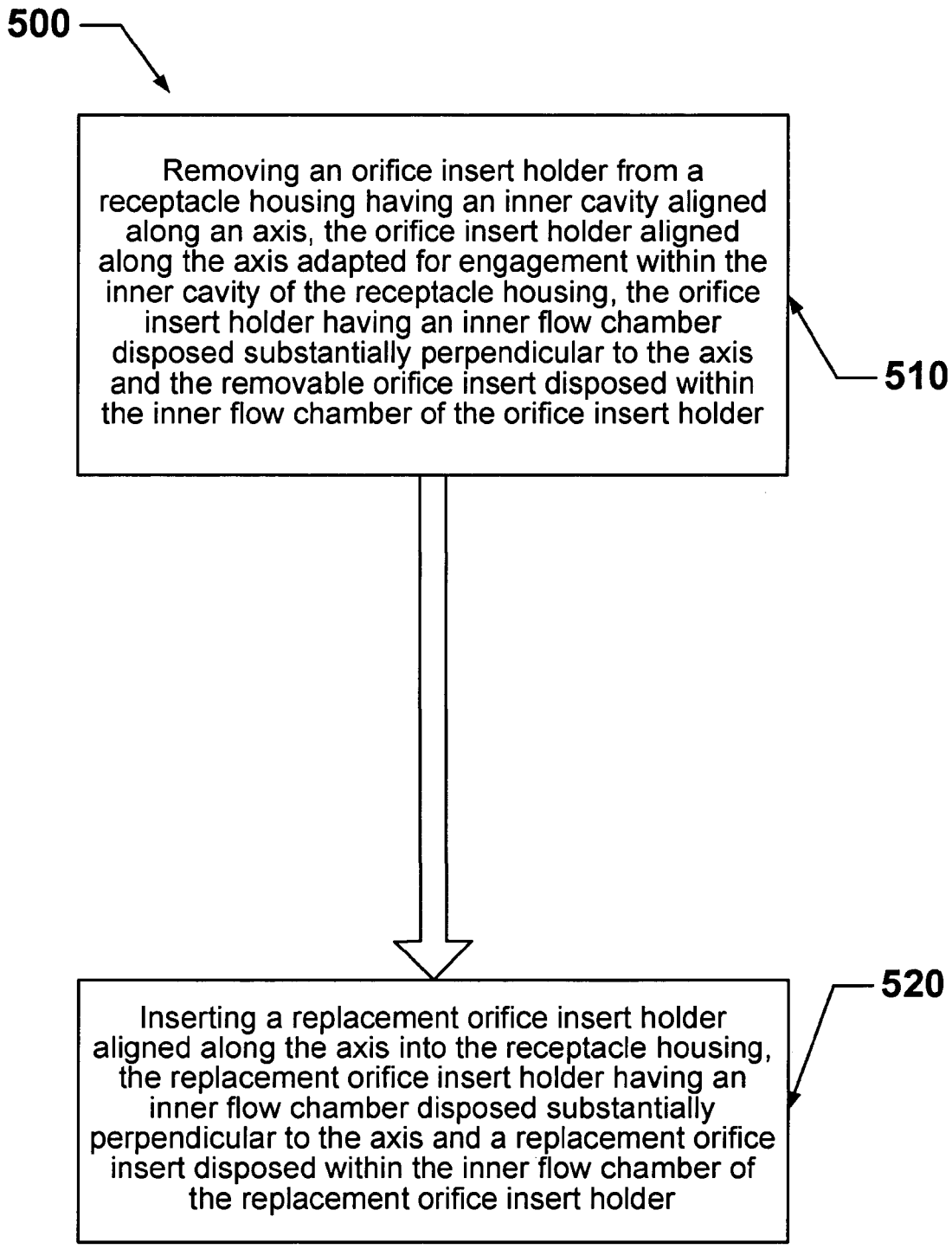
FIG. 5 schematically illustrates an exemplary embodiment of a method according to the present invention for replacing a removable orifice insert in a subsea valve assembly.

In various illustrative embodiments, as shown in FIG. 5, a method 500 of replacing a removable orifice insert in a subsea valve assembly may be provided. The method 500 may comprise removing an orifice insert holder from a receptacle housing having an inner cavity aligned along an axis, the orifice insert holder aligned along the axis adapted for engagement within the inner cavity of the receptacle housing, the orifice insert holder having an inner flow chamber disposed substantially perpendicular to the axis and the removable orifice insert disposed within the inner flow chamber of the orifice insert holder, as indicated at 510. For example, as described above, the removable orifice insert holder 114 may be removed from the threaded receptacle housing 112 having the inner cavity 116 aligned along the axis 117, the removable orifice insert holder 114 aligned along the axis 117 adapted for engagement within the inner cavity 116 of the threaded receptacle housing 112, the removable orifice insert holder 114 having the inner flow chamber 141 disposed substantially perpendicular to the axis 117 and the removable orifice insert 142 disposed within the inner flow chamber 141 of the removable orifice insert holder 114.

The method 500 may also comprise inserting a replacement orifice insert holder aligned along the axis into the receptacle housing, the replacement orifice insert holder having an inner flow chamber disposed substantially perpendicular to the axis and a replacement orifice insert disposed within the inner flow chamber of the replacement orifice insert holder, as indicated at 520. For example, as described above, the replacement orifice insert holder 114 aligned along the axis 117 may be inserted into the threaded receptacle housing 112, the replacement orifice insert holder 114 having the inner flow chamber 141 disposed substantially perpendicular to the axis 117 and the replacement orifice insert 142 disposed within the inner flow chamber 141 of the replacement orifice insert holder 114.

Figure 6:
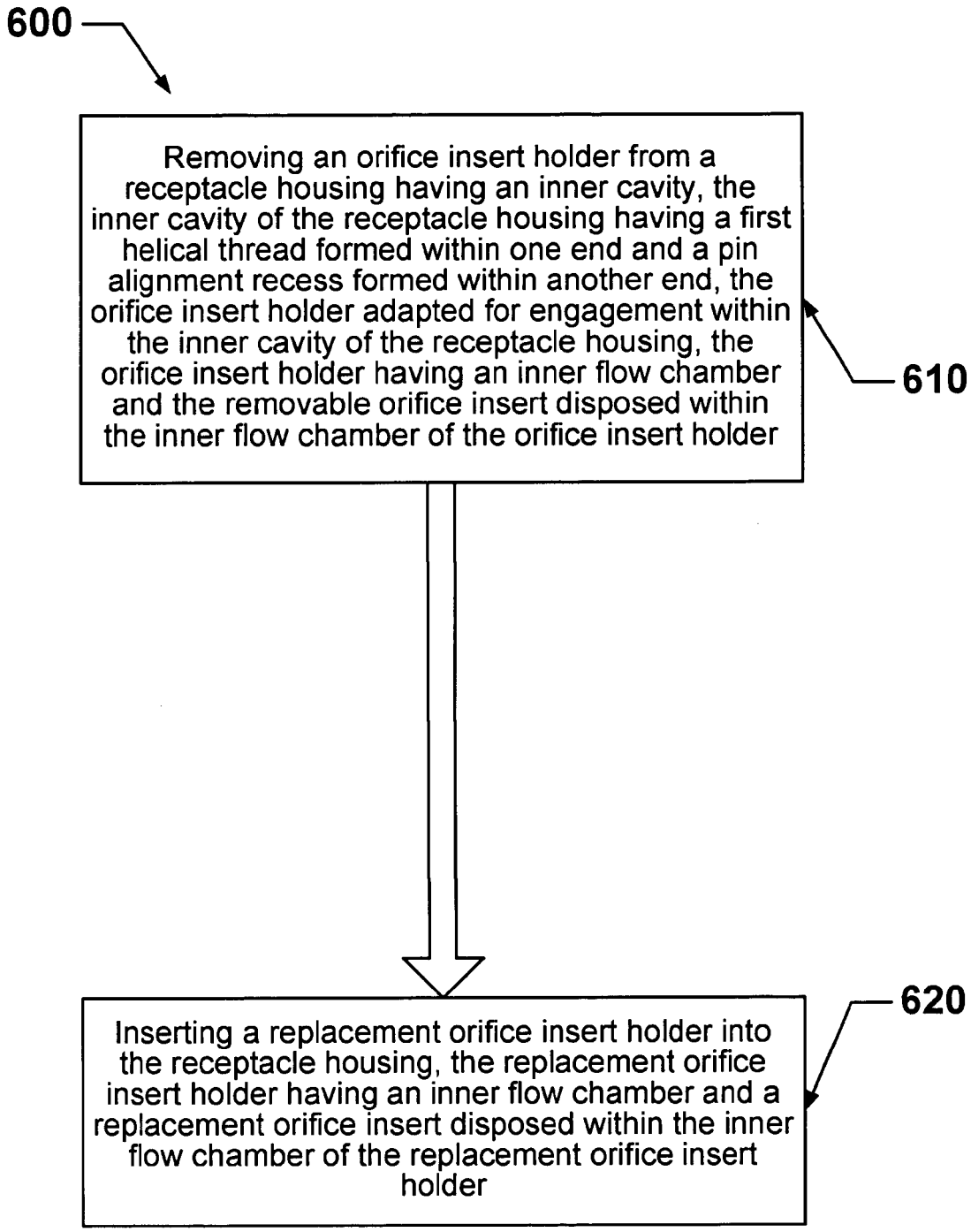
FIG. 6 schematically illustrates another exemplary embodiment of a method according to the present invention for replacing a removable orifice insert in a subsea valve assembly.

In various alternative illustrative embodiments, as shown in FIG. 6, a method 600 of replacing a removable orifice insert in a subsea valve assembly may be provided. The method 600 may comprise removing an orifice insert holder from a receptacle housing having an inner cavity, the inner cavity of the receptacle housing having a first helical thread formed within one end and a pin alignment recess formed within another end, the orifice insert holder adapted for engagement within the inner cavity of the receptacle housing, the orifice insert holder having an inner flow chamber and the removable orifice insert disposed within the inner flow chamber of the orifice insert holder, as indicated at 610. For example, as described above, the removable orifice insert holder 114 may be removed from the threaded receptacle housing 112 having the inner cavity 116, the inner cavity 116 of the threaded receptacle housing 112 having the helical thread 118 formed within one end and the pin alignment recess 120 formed within another end, the removable orifice insert holder 114 adapted for engagement within the inner cavity 116 of the threaded receptacle housing 112, the removable orifice insert holder 114 having an inner flow chamber 141 and the removable orifice insert 142 disposed within the inner flow chamber 141 of the removable orifice insert holder 114.

The method 600 may also comprise inserting a replacement orifice insert holder into the receptacle housing, the replacement orifice insert holder having an inner flow chamber and a replacement orifice insert disposed within the inner flow chamber of the replacement orifice insert holder, as indicated at 620. For example, as described above, the replacement orifice insert holder 114 may be inserted into the threaded receptacle housing 112, the replacement orifice insert holder 114 having the inner flow chamber 141 and the replacement orifice insert 142 disposed within the inner flow chamber 141 of the replacement orifice insert holder 114.

As those of ordinary skill in the art, having the benefit of the present disclosure, will recognize, the present invention has numerous applications, including the ability to change the flow rate of subsea fluids using a removable fixed orifice insert. Therefore the present invention are well adapted to carry out the objects and attain the ends and advantages mentioned, as well as those that are inherent therein. While the present invention has been depicted, described, and defined by reference to exemplary embodiments of the present invention, such a reference does not imply any limitation of the present invention, and no such limitation is to be inferred. The present invention is capable of considerable modification, alteration, and equivalency in form and function as will occur to those of ordinary skill in the pertinent arts having the benefit of this disclosure. The depicted and described illustrative embodiments of the present invention are exemplary only and are not exhaustive of the scope of the present invention. Consequently, the present invention is intended to be limited only by the spirit and scope of the appended claims, giving full cognizance to equivalents in all respects.

The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. In particular, every range of values (of the form, "from about a to about b," or, equivalently, "from approximately a to b," or, equivalently, "from approximately a-b") disclosed herein is to be understood as referring to the power set (the set of all subsets) of the respective range of values, in the sense of Georg Cantor. Accordingly, the protection sought herein is as set forth in the claims below.

What is claimed is:

1. A subsea valve assembly, comprising:

a receptacle housing having an inner cavity aligned along an axis;

an orifice insert holder aligned along the axis adapted for engagement within the inner cavity of the receptacle housing, the orifice insert holder having an inner flow chamber disposed substantially perpendicular to the axis; and a removable orifice insert disposed within the inner flow chamber of the orifice insert holder, wherein the removable orifice insert can be removed from the orifice insert holder, wherein the orifice insert holder comprises a main body, a torque body, and an alignment pin coupled thereto, and a T-handle attached to the torque body.

2. The subsea valve assembly according to claim 1, wherein the torque body is rotationally mounted on a shaft attached to the main body of the orifice insert holder.

3. The subsea valve assembly according to claim 2, further comprising a shear pin, which is capable of temporarily rotationally securing the torque body to the main body.

4. The subsea valve assembly according to claim 1, further comprising a pair of elastomeric seal rings disposed within a corresponding pair of circular grooves formed within an outer surface of the main body above and below the inner flow chamber of the orifice insert holder.

5. The subsea valve assembly according to claim 1, further comprising a pair of metal lip seal rings disposed within a corresponding pair of circular grooves formed within an outer surface of the main body above and below the inner flow chamber of the orifice insert holder.

6. The subsea valve assembly according to claim 1, further comprising a wiper seal ring disposed within a corresponding circular groove formed within an outer surface of the main body located below the inner flow chamber.

7. The subsea valve assembly according to claim 1, further comprising a thrust washer and lock ring for keeping the torque body coupled to the main body.

8. A subsea valve assembly, comprising:

a threaded receptacle housing having an inner cavity aligned along an axis;

a removable orifice insert holder aligned along the axis adapted for engagement within the inner cavity of the receptacle housing, the removable orifice insert holder having an inner flow chamber disposed substantially perpendicular to the axis; and a removable orifice insert disposed within the inner flow chamber of the removable orifice insert holder, wherein the removable orifice insert can be removed from the orifice insert holder, wherein the removable orifice insert holder comprises a main body, a torque body, and an alignment pin coupled thereto, and a T-handle attached to the torque body.

9. The subsea valve assembly according to claim 8, wherein the torque body is rotationally mounted on a shaft attached to the main body of the removable orifice insert holder.

10. The subsea valve assembly according to claim 9, further comprising a shear pin, which is capable of temporarily rotationally securing the torque body to the main body.

11. The subsea valve assembly according to claim 8, further comprising a pair of elastomeric seal rings disposed within a corresponding pair of circular grooves formed within an outer surface of the main body above and below the inner flow chamber of the removable orifice insert holder.

12. The subsea valve assembly according to claim 8, further comprising a pair of metal lip seal rings disposed within a corresponding pair of circular grooves formed within an outer surface of the main body above and below the inner flow chamber of the removable orifice insert holder.

13. The subsea valve assembly according to claim 8, further comprising a wiper seal ring disposed within a corresponding circular groove formed within an outer surface of the main body located below the inner flow chamber.

14. The subsea valve assembly according to claim 8, further comprising a thrust washer and lock ring for keeping the torque body coupled to the main body.

15. A method of replacing a removable orifice insert in a subsea valve assembly, the method comprising:

removing an orifice insert holder from a receptacle housing having an inner cavity aligned along an axis, the orifice insert holder aligned along the axis adapted for engagement within the inner cavity of the receptacle housing, the orifice insert holder having an inner flow chamber disposed substantially perpendicular to the axis and the removable orifice insert disposed within the inner flow chamber of the orifice insert holder, wherein the removable orifice insert can be removed from the orifice insert holder; and inserting a replacement orifice insert holder aligned along the axis into the receptacle housing, the replacement orifice insert holder having an inner flow chamber disposed substantially perpendicular to the axis and a replacement orifice insert disposed within the inner flow chamber of the replacement orifice insert holder, wherein removing the orifice insert holder from the receptacle housing comprises applying a reverse torque to the orifice insert holder through a T-handle attached to a torque body, the torque body having a second helical thread formed on an outer surface of the torque body, the second helical thread adapted for engagement with the first helical thread formed within the inner cavity of the receptacle housing, the reverse torque applied to the orifice insert causing eventual disengagement of the first helical thread from the second helical thread, wherein the orifice insert holder comprises a main body, the torque body, and an alignment pin coupled thereto, and the T-handle attached to the torque body, the torque body rotationally mounted on a shaft attached to the main body of the orifice insert holder.

16. A method of replacing a removable orifice insert in a subsea valve assembly, the method comprising:

removing an orifice insert holder from a receptacle housing having an inner cavity aligned along an axis, the orifice insert holder aligned along the axis adapted for engagement within the inner cavity of the receptacle housing, the orifice insert holder having an inner flow chamber disposed substantially perpendicular to the axis and the removable orifice insert disposed within the inner flow chamber of the orifice insert holder, wherein the removable orifice insert can be removed from the orifice insert holder; and inserting a replacement orifice insert holder aligned along the axis into the receptacle housing, the replacement orifice insert holder having an inner flow chamber disposed substantially perpendicular to the axis and a replacement orifice insert disposed within the inner flow chamber of the replacement orifice insert holder, wherein the inner cavity of the receptacle housing has a first helical thread formed within one end and a pin alignment recess formed within another end and wherein inserting the replacement orifice insert holder into the receptacle housing comprises axially and vertically aligning the replacement orifice insert with the inner cavity of the receptacle housing.

17. The method according to claim 16, wherein inserting the replacement orifice insert holder into the receptacle housing comprises guiding the replacement orifice insert holder into the inner cavity using an alignment pin until the alignment pin lands on a bottom wall of the inner cavity, wherein the replacement orifice insert holder comprises a main body, a torque body, and the alignment pin coupled thereto, and a T-handle attached to the torque body, the torque body rotationally mounted on a shaft attached to the main body of the replacement orifice insert holder.

18. The method according to claim 17, wherein the inner cavity of the receptacle housing has a first helical thread formed within one end and a pin alignment recess formed within another end and wherein inserting the replacement orifice insert holder into the receptacle housing comprises rotating the replacement orifice insert holder until the alignment pin is substantially aligned with the alignment recess.

19. The method according to claim 18, wherein inserting the replacement orifice insert holder into the receptacle housing comprises pushing the replacement orifice insert holder further into the inner cavity until the first helical thread engages with a second helical thread formed on an outer surface of the torque body, the second helical thread adapted for engagement with the first helical thread formed within the inner cavity of the receptacle housing.

20. The method according to claim 19, wherein inserting the replacement orifice insert holder into the receptacle housing comprises applying a torque to the replacement orifice insert holder through the T-handle attached to the torque body until a shear pin, which is capable of temporarily rotationally securing the torque body to the main body, shears when the torque reaches a predetermined torque value.

21. The method according to claim 20, wherein inserting the replacement orifice insert holder into the receptacle housing comprises rotating the torque body relative to the main body about the shaft attached to the main body of the replacement orifice insert holder.

22. The method according to claim 21, wherein inserting the replacement orifice insert holder into the receptacle housing comprises advancing the torque body into the inner cavity as the second helical thread formed on an outer surface of the torque body engages with the first helical thread formed within the inner cavity of the receptacle housing.

23. The method according to claim 22, wherein inserting the replacement orifice insert holder into the receptacle housing comprises forcing the main body into the inner cavity and the alignment pin into the alignment pin recess until the replacement orifice insert holder is substantially completely engaged with the inner cavity of the receptacle housing and the inner flow chamber is substantially aligned with an input port that connects to the inner cavity and an output port that connects to the inner cavity.

24. A subsea valve assembly, comprising:

a receptacle housing having an inner cavity, the inner cavity of the receptacle housing having a helical thread formed within one end and a pin alignment recess formed within another end;

an orifice insert holder adapted for engagement within the inner cavity of the receptacle housing, the orifice insert holder having an inner flow chamber; and a removable orifice insert disposed within the inner flow chamber of the orifice insert holder, wherein the removable orifice insert can be removed from the orifice insert holder.

25. The subsea valve assembly according to claim 24, wherein the receptacle housing further comprises an input port that connects to the inner cavity and an output port that connects to the inner cavity.

26. The subsea valve assembly according to claim 24, wherein the orifice insert holder comprises a main body, a torque body, and an alignment pin coupled thereto, and a T-handle attached to the torque body.

27. The subsea valve assembly according to claim 26, wherein the torque body is rotationally mounted on a shaft attached to the main body of the orifice insert holder.

28. The subsea valve assembly according to claim 27, further comprising a shear pin, which is capable of temporarily rotationally securing the torque body to the main body.

29. The subsea valve assembly according to claim 26, further comprising a pair of elastomeric seal rings disposed within a corresponding pair of circular grooves formed within an outer surface of the main body above and below the inner flow chamber of the orifice insert holder.

30. The subsea valve assembly according to claim 26, further comprising a pair of metal lip seal rings disposed within a corresponding pair of circular grooves formed within an outer surface of the main body above and below the inner flow chamber of the orifice insert holder.

31. The subsea valve assembly according to claim 26, further comprising a wiper seal ring disposed within a corresponding circular groove formed within an outer surface of the main body located below the inner flow chamber.

32. The subsea valve assembly according to claim 26, further comprising a thrust washer and lock ring for keeping the torque body coupled to the main body.

33. The subsea valve assembly according to claim 24, further comprising an orifice retainer nut that retains the orifice insert within the inner flow chamber of the orifice insert holder.

34. A subsea valve assembly, comprising:

a threaded receptacle housing having an inner cavity, the inner cavity of the threaded receptacle housing having a helical thread formed within one end and a pin alignment recess formed within another end;

an removable orifice insert holder adapted for engagement within the inner cavity of the receptacle housing, the removable orifice insert holder having an inner flow chamber; and a removable orifice insert disposed within the inner flow chamber of the removable orifice insert holder, wherein the removable orifice insert can be removed from the orifice insert holder.

35. The subsea valve assembly according to claim 34, wherein the threaded receptacle housing further comprises an input port that connects to the inner cavity and an output port that connects to the inner cavity.

36. The subsea valve assembly according to claim 34, wherein the removable orifice insert holder comprises a main body, a torque body, and an alignment pin coupled thereto, and a T-handle attached to the torque body.

37. The subsea valve assembly according to claim 36, wherein the torque body is rotationally mounted on a shaft attached to the main body of the removable orifice insert holder.

38. The subsea valve assembly according to claim 37, further comprising a shear pin, which is capable of temporarily rotationally securing the torque body to the main body.

39. The subsea valve assembly according to claim 36, further comprising a pair of elastomeric seal rings disposed within a corresponding pair of circular grooves formed within an outer surface of the main body above and below the inner flow chamber of the removable orifice insert holder.

40. The subsea valve assembly according to claim 36, further comprising a pair of metal lip seal rings disposed within a corresponding pair of circular grooves formed within an outer surface of the main body above and below the inner flow chamber of the removable orifice insert holder.

41. The subsea valve assembly according to claim 36, further comprising a wiper seal ring disposed within a corresponding circular groove formed within an outer surface of the main body located below the inner flow chamber.

42. The subsea valve assembly according to claim 36, further comprising a thrust washer and lock ring for keeping the torque body coupled to the main body.

43. The subsea valve assembly according to claim 34, further comprising an orifice retainer nut that retains the removable orifice insert within the inner flow chamber of the removable orifice insert holder.

44. A subsea valve assembly, comprising:

a receptacle housing having an inner cavity aligned along an axis and a pin alignment recess formed at an end of the inner cavity which is offset from the axis;

an orifice insert holder aligned along the axis adapted for engagement within the inner cavity of the receptacle housing, the orifice insert holder having an inner flow chamber disposed substantially perpendicular to the axis and an alignment pin offset from the axis, which is adapted for receipt in the pin alignment recess; and a removable orifice insert disposed within the inner flow chamber of the orifice insert holder, wherein the removable orifice insert can be removed from the orifice insert holder.

45. The subsea valve assembly according to claim 44, wherein the receptacle housing further comprises an input port that connects to the inner cavity and an output port that connects to the inner cavity.

46. The subsea valve assembly according to claim 44, wherein the orifice insert holder comprises a main body, a torque body, and a torque applying means attached to the torque body.

47. The subsea valve assembly according to claim 46, wherein the torque body is rotationally mounted on a shaft attached to the main body of the orifice insert holder.

48. The subsea valve assembly according to claim 47, further comprising a shear pin, which is capable of temporarily rotationally securing the torque body to the main body.

49. The subsea valve assembly according to claim 46, further comprising a pair of elastomeric seal rings disposed within a corresponding pair of circular grooves formed within an outer surface of the main body above and below the inner flow chamber of the orifice insert holder.

50. The subsea valve assembly according to claim 46, further comprising a pair of metal lip seal rings disposed within a corresponding pair of circular grooves formed within an outer surface of the main body above and below the inner flow chamber of the orifice insert holder.

51. The subsea valve assembly according to claim 46, further comprising a wiper seal ring disposed within a corresponding circular groove formed within an outer surface of the main body located below the inner flow chamber.

52. The subsea valve assembly according to claim 46, further comprising a thrust washer and lock ring for keeping the torque body coupled to the main body.

53. The subsea valve assembly according to claim 44, further comprising an orifice retainer nut that retains the orifice insert within the inner flow chamber of the orifice insert holder.

* * * * *